US011174827B1

(12) United States Patent
Tatikonda et al.

(10) Patent No.: US 11,174,827 B1
(45) Date of Patent: Nov. 16, 2021

(54) FUEL INJECTOR WITH INTERNAL RADIAL SEAL WITH THIN WALL COUNTERBORE

(71) Applicant: Caterpillar Inc., Peoria, IL (US)

(72) Inventors: Venkata R. Tatikonda, Peoria, IL (US); Manjunath Bannur Nagaraja, Naperville, IL (US); Stephen Robert Lewis, Chillicothe, IL (US); Adam Charles Hill, Pontiac, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/024,891

(22) Filed: Sep. 18, 2020

(51) Int. Cl.
*F02M 61/14* (2006.01)
*F02M 61/18* (2006.01)

(52) U.S. Cl.
CPC ..... *F02M 61/14* (2013.01); *F02M 61/1893* (2013.01); *F02M 2200/858* (2013.01)

(58) Field of Classification Search
CPC ..... F02M 61/14; F02M 61/1893; F02M 2200/858
USPC ..... 123/467
See application file for complete search history.

(56) References Cited

U.S. PATENT DOCUMENTS 3,945,353 A * 3/1976 Dreisin ..... F01P 9/02 123/41.22
4,230,273 A 10/1980 Claxton et al.
5,241,935 A * 9/1993 Beck ..... F02M 61/06 123/300
5,330,100 A * 7/1994 Malinowski ..... B05B 17/0607 239/102.2
5,540,388 A * 7/1996 Sasao ..... F02M 51/0678 239/417.3
5,613,640 A * 3/1997 Furuya ..... F02M 51/0671 239/585.5
5,823,429 A * 10/1998 Beck ..... F02M 57/025 239/5
5,852,997 A * 12/1998 Vanderpoel ..... F02M 63/0225 123/446
6,367,721 B1 * 4/2002 Ikeya ..... F02M 51/0671 239/533.7
6,666,390 B2 12/2003 Itou
7,121,476 B2 10/2006 Buehler et al.
8,544,767 B2 10/2013 Adachi et al.
10,077,748 B2 9/2018 Benson et al.
2003/0111625 A1 * 6/2003 Kuehne ..... F16K 31/0651 251/129.19

(Continued)

FOREIGN PATENT DOCUMENTS

DE 102013003104 A1 8/2014
EP 0748418 B1 7/1997

(Continued)

*Primary Examiner* — Mahmoud Gimie
(74) *Attorney, Agent, or Firm* — Law Office of Kurt J. Fugman LLC

(57) ABSTRACT

A fuel injector body includes an at least partially annular configuration defining a longitudinal axis, a circumferential direction, and a radial direction. A first counterbore and a first cavity extend from the first end toward the second end, and an external interface portion includes a sealing surface disposed axially between the first end and a shoulder. The first cavity defines a bottom surface and a peripheral surface defining a first cavity diameter, and the sealing surface defines a sealing surface diameter. A ratio of the sealing surface diameter to the first cavity diameter ranges from 0.3 to 4.4.

20 Claims, 6 Drawing Sheets

(56) References Cited

U.S. PATENT DOCUMENTS

| | | | |
|---|---|---|---|
| 2012/0205470 | A1 | 8/2012 | Spindler et al. |
| 2017/0241550 | A1 | 8/2017 | Sabotta et al. |

FOREIGN PATENT DOCUMENTS

| | | | |
|---|---|---|---|
| EP | 1783357 | A1 | 5/2007 |
| WO | 2019078881 | A1 | 4/2019 |

* cited by examiner

FUEL INJECTOR WITH INTERNAL RADIAL SEAL WITH THIN WALL COUNTERBORE

TECHNICAL FIELD

The present disclosure relates generally to fuel injectors that use an interface between the fuel injector body and the nozzle that may leak. More specifically, the present disclosure relates to such fuel injectors that provide a seal to reduce the likelihood of leaks developing at this interface.

BACKGROUND

Fuel injectors are used in internal combustion engines to inject fuel into the combustion chamber before the air/fuel mixture is ignited. Such fuel injectors are typically made as assemblies of a plurality of components to aid in their manufacture and repair. For example, fuel injector assemblies are often assembled using a nozzle that interfaces with a fuel injector body. A joint may be located between the nozzle and the fuel injector body through which fuel at high pressure may leak.

To avoid the need for a face seal at this interface which creates component stack up uncertainty, which may lead to leaks. Also, machining such a face seal feature may be expensive. Any remedy to these problems may be constrained to a solution that is a "drop-in" replacement. That is to say, the fuel injector assembly with such a solution may need to work in existing engines by fitting into an existing envelope.

Also, these fuel injector assemblies may employ solenoid assemblies that activate the injection of the fuel. In some current designs, an effective path for high pressure fuel to flow to a drain is not provided when a problem occurs in the nozzle (e.g. a component becomes stuck). This may result in contamination of fuel into the oil of the engine. Moreover, damage may also occur to the solenoid assembly or other component of the fuel injector.

Again, a remedy to these problems may be constrained so that the solution is a "drop-in" solution.

SUMMARY OF THE DISCLOSURE

A fuel injector body for use with a fuel injector according to an embodiment of the present disclosure is provided. The fuel injector body may comprise a body that includes an at least partially annular configuration defining a longitudinal axis, a circumferential direction, and a radial direction. A first end may be disposed axially along the longitudinal axis, and a second end may be disposed axially along the longitudinal axis. A first counterbore and a first cavity may extend from the first end toward the second end, and an external interface portion may include a sealing surface that is disposed axially between the first end and a shoulder. The first cavity may define a bottom surface and a peripheral surface, the peripheral surface defining a first cavity diameter, and the sealing surface defining a sealing surface diameter, and a ratio of the sealing surface diameter to the first cavity diameter may range from 0.3 to 4.4.

A nozzle for use with a fuel injector according to an embodiment of the present disclosure is provided. The nozzle may comprise a body that includes at least a partially stepped annular configuration that defines a radial direction, a circumferential direction, and a longitudinal axis. A first longitudinal end may be disposed axially along the longitudinal axis, and a second longitudinal end may be disposed axially along the longitudinal axis. An attachment portion may be disposed at the second longitudinal end, and a tip portion may be disposed at the first longitudinal end defining an injection outlet. The attachment portion includes a fuel injector body receiving cavity defining an inner circumferential surface that includes internal threads extending from the second longitudinal end, and that defines a seal receiving groove that is disposed axially below the internal threads.

A fuel injector assembly according to an embodiment of the present disclosure is provided. The assembly may comprise a fuel injector component that defines a pressurized fuel chamber, a check valve assembly in fluid communication with the pressurized fuel chamber, and a fuel injector body that includes an at least partially annular configuration defining a longitudinal axis, a circumferential direction, a radial direction, and a first end disposed along the longitudinal axis, a second end disposed along the longitudinal axis, and also defining a first counterbore, and a first cavity that extends longitudinally from the first end toward the second end terminating short thereof. A nozzle may define a first longitudinal end, and a second longitudinal end that is disposed longitudinally adjacent to the first end of the fuel injector body, and a second counterbore and a second cavity that extends longitudinally from the second longitudinal end toward the first longitudinal end. The first end of the fuel injector body may be disposed in the second counterbore and the second cavity of the nozzle, forming an interface region with the nozzle, and a seam between the fuel injector body and the nozzle, and the fuel injector assembly may further define a radial seal receiving groove disposed longitudinally along the seam.

DETAILED DESCRIPTION

Figure 1:
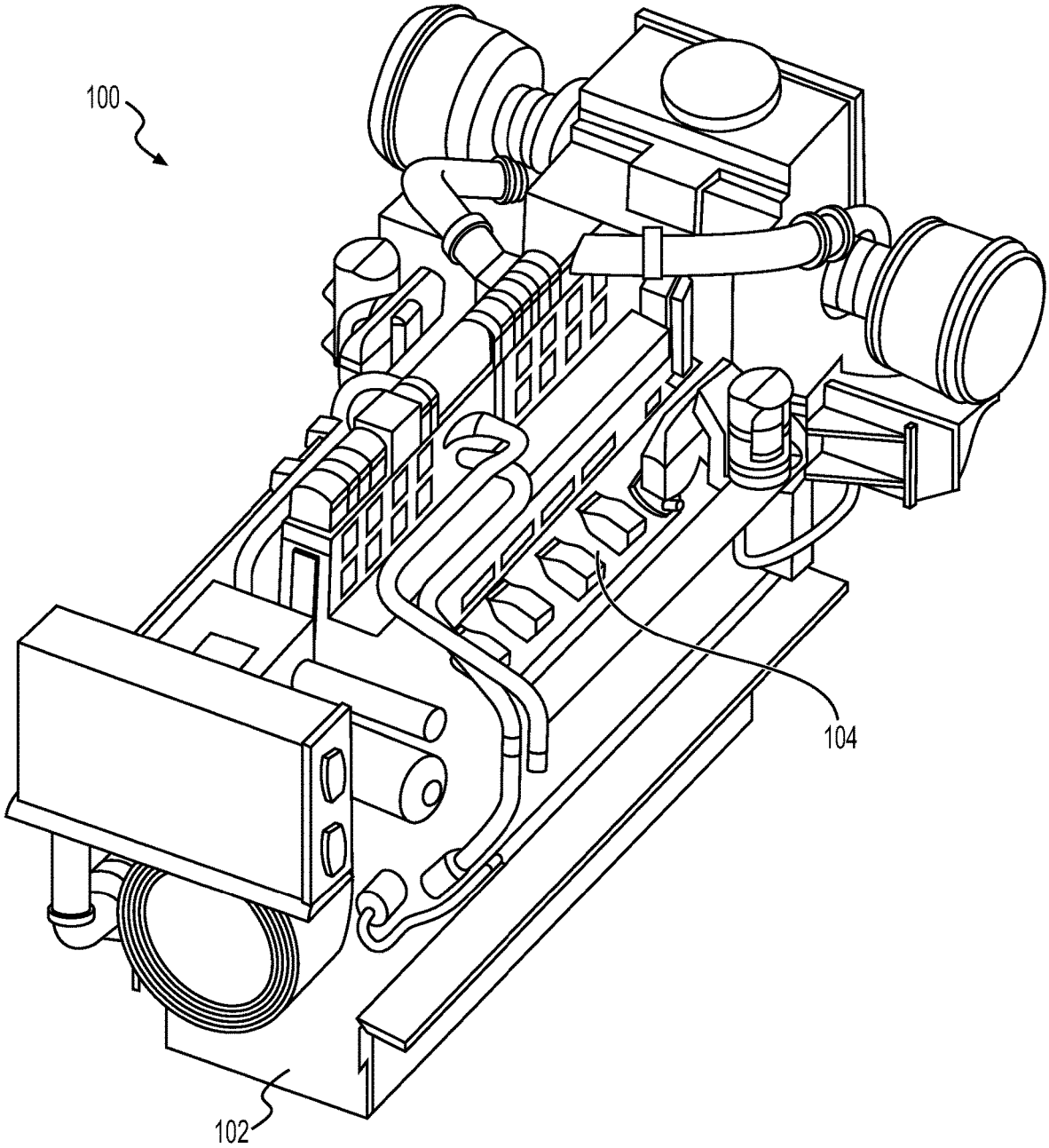
FIG. 1 is a perspective view of an engine employing various embodiments of a fuel injector of the present disclosure.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100a, 100b or a prime indicator such as 100', 100" etc. It is to be understood that the use of letters or primes immediately after a reference number indicates that these features are similarly shaped and have similar function as is often the case when geometry is mirrored about a plane of symmetry. For ease of explanation in this specification, letters or primes will often not be included herein but may be shown in the drawings to indicate duplications of features discussed within this written specification.

While the application discussed herein is primarily a common rail unit injector, so-called as the fuel is supplied at high pressure from a common source and is not pressurized in the fuel injector, it is to be understood that in other embodiments the fuel injector that uses the same features described herein may be powered to inject in another manner, such as mechanically, hydraulically, or controlled in another manner, etc. Similarly, the type of fuel injected by the injector may be varied and includes diesel fuel, gasoline, etc. Accordingly, the applications of the embodiments discussed herein are applicable to a host of engine types and to a host of machines driven by such engines.

For example, an internal combustion engine 100 is shown in FIG. 1 that may employ various embodiments of the fuel injector assembly. The engine 100 may include an engine block 102 in which the piston (not shown) reciprocates, and a cylinder head 104 that may contain various engine components for the introduction of fluids into the bore/combustion chamber located in the engine block 102.

Figure 2:
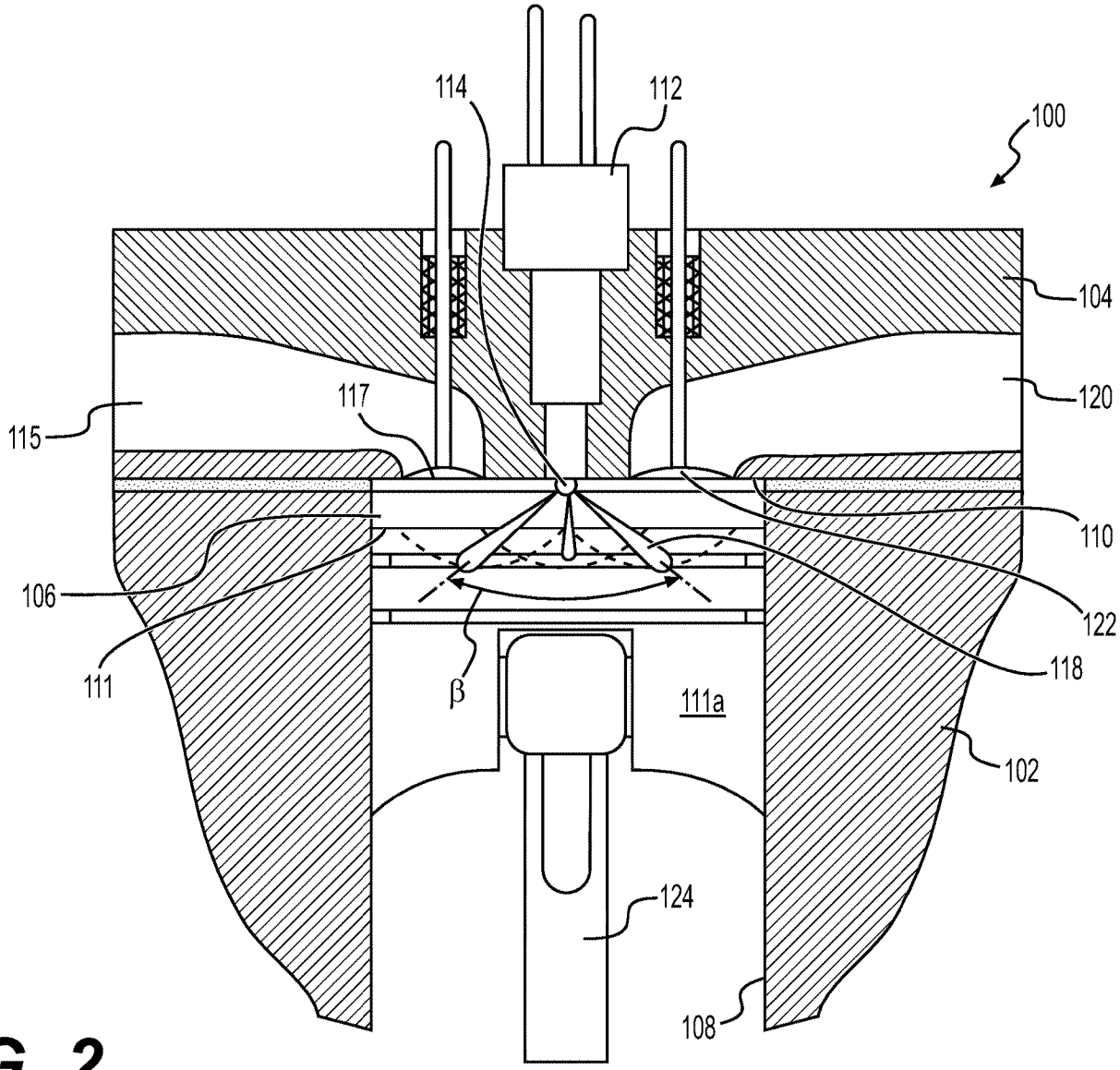
FIG. 2 is a sectional side view showing the use of a fuel injector in a single cylinder of the engine of FIG. 1.

Turning to FIG. 2, a portion of the engine 100 is shown sectioned, revealing the combustion chamber 106 that may have a generally cylindrical shape that is defined within a cylinder bore 108 formed within the crankcase or engine block 102 of the engine 100. The combustion chamber 106 is further defined at one end by a flame deck surface 110 of the cylinder head 104, and at another end by a crown portion 111 of a piston 111*a* that is reciprocally disposed within the bore 108, and is connected to a connecting rod 124, which in turn is connected to a crank shaft (not shown). A fuel injector 112 is mounted in the cylinder head 104. The injector 112 has a tip 114 that protrudes within the combustion chamber 106 through the flame deck surface 110 such that it can directly inject fuel into the combustion chamber 106.

During operation of the engine 100, air is admitted into the combustion chamber 106 via an air inlet passage 115 when one or more intake valves 117 (one shown) are open during an intake stroke. In a known configuration, high pressure fuel is permitted to flow through nozzle openings in the tip 114 to form fuel jets that enter the combustion chamber 106. Each nozzle opening creates a fuel jet 118 that generally disperses to create a predetermined fuel/air mixture, which in a compression ignition engine as shown in FIGS. 1 and 2 auto-ignites and combusts. The fuel jets 118 may be provided from the injector at an included angle $\beta$ of between 110 and 150 degrees, but other angles may also be used. In some embodiments, a single nozzle opening may be provided, etc. Following combustion, exhaust gas is expelled from the combustion chamber through an exhaust conduit 120 when one or more exhaust valves 122 (one shown) is/are open during an exhaust stroke.

The uniformity and extent of fuel/air mixing in the combustion cylinder is relevant to the combustion efficiency as well as to the amount and type of combustion byproducts that are formed. For example, fuel-rich mixtures, which may be locally present within the combustion chamber 106 during a combustion event due to insufficient mixing, may lead to higher soot emissions and lower combustion efficiency.

Turning now to FIGS. 3 thru 6, a fuel injector assembly 200 according to an embodiment of the present disclosure that may be used in the engine 100 just described will now be discussed in general terms concerning its construction and operation.

Figure 3:
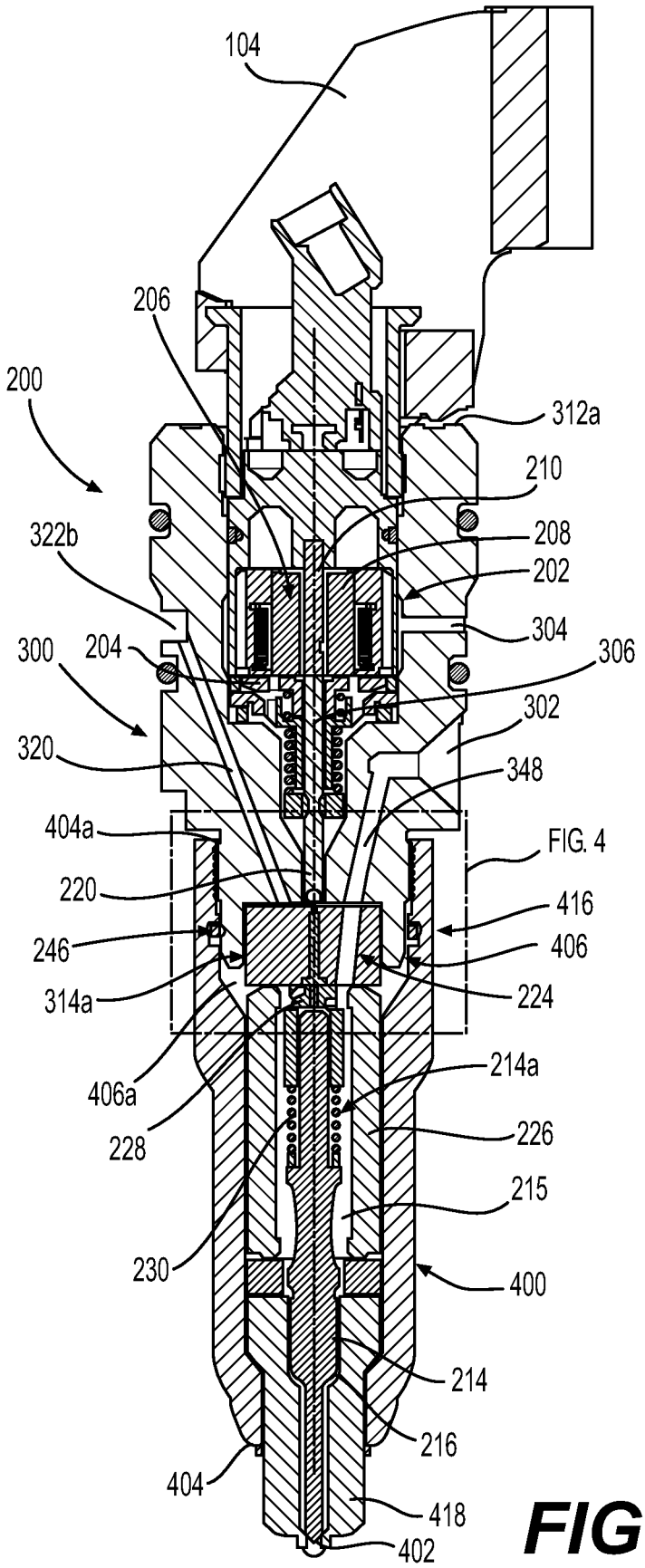
FIG. 3 is a sectional side view of a fuel injector assembly that may use a fuel injector body with a thin wall counterbore with the thin wall contacting a radial seal housed in the nozzle.

In FIG. 3, the fuel injector assembly 200 includes a fuel injector body 300 that defines a common rail inlet 302, and a nozzle 400 that includes an injection outlet 402.

Focusing on fuel injector body 300 in FIG. 3, it can be seen that it includes a drain outlet 304 and a low pressure drain groove 322*b* that is in fluid communication with the drain outlet 304. The common rail inlet 302 may take the form of a conical seat to sealingly engage a quill fluidly connected to a common rail pressure source, but not necessarily so. A solenoid actuator 202 (may be an assembly) may be disposed in the injector body 300, and includes an armature 204 that moves with respect to a stator assembly 206. Stator assembly 206 includes a pole piece 208 and a stop pin 210 that are flush at an air gap plane 212 (only shown in FIG. 6).

Figure 6:
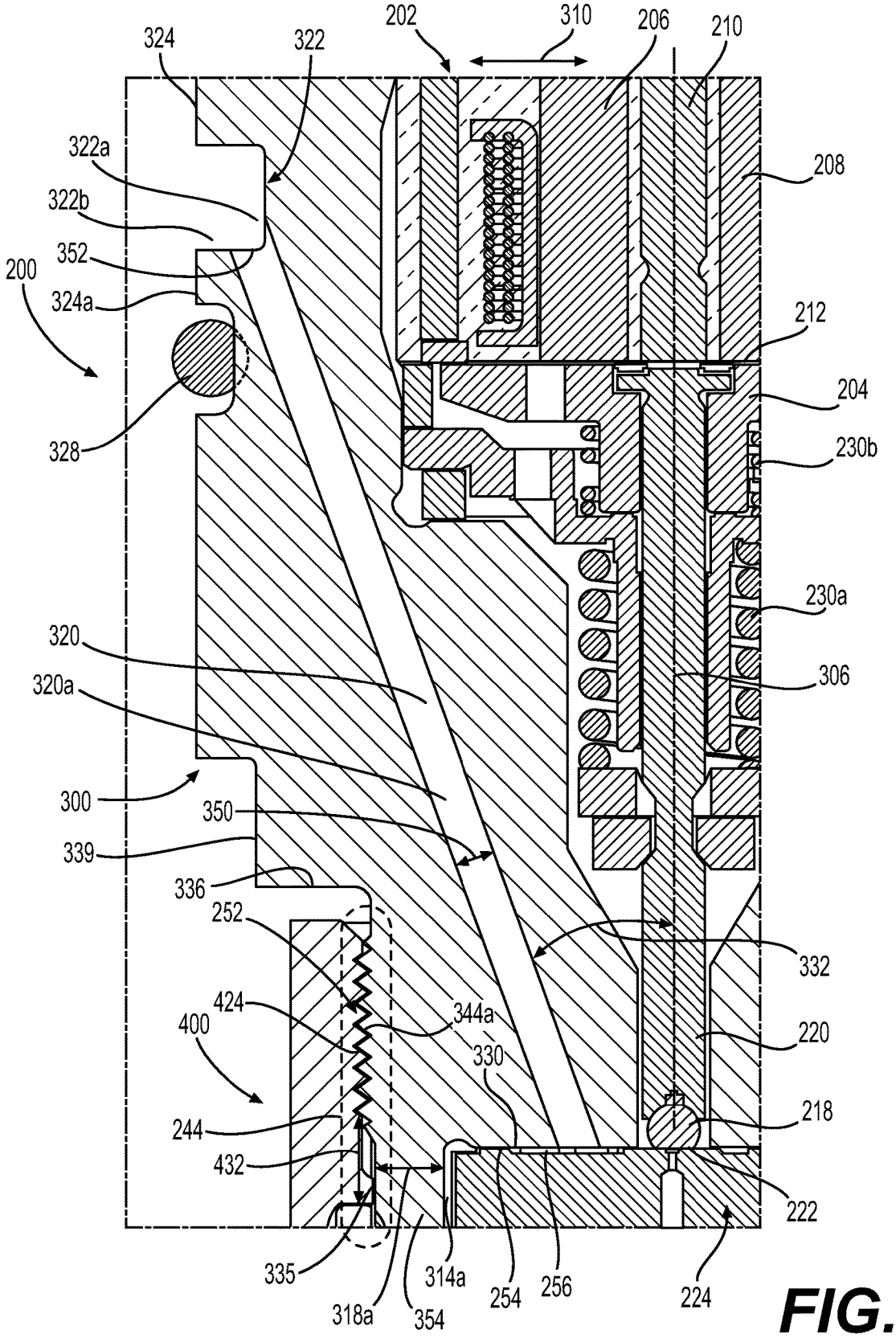
FIG. 6 is an enlarged detail view of the fuel injector assembly of FIG. 5, showing more clearly the internal leak passage that connects the low pressure drain groove on the periphery of the fuel injector body to the counterbore cavity that is surrounded by the nozzle.

In FIG. 6, the stator assembly 206 may be substantially free of empty space between pole piece 208 and a centerline (may be the same as the longitudinal axis 306 of the fuel injector body 300, but not necessarily so). In addition, the stop pin 210 may be surrounded by, but radially spaced apart from, the pole piece 208, such as by a plastic filler material that may also serve to magnetically isolate the stop pin 210 from the pole piece 208.

Figure 4:
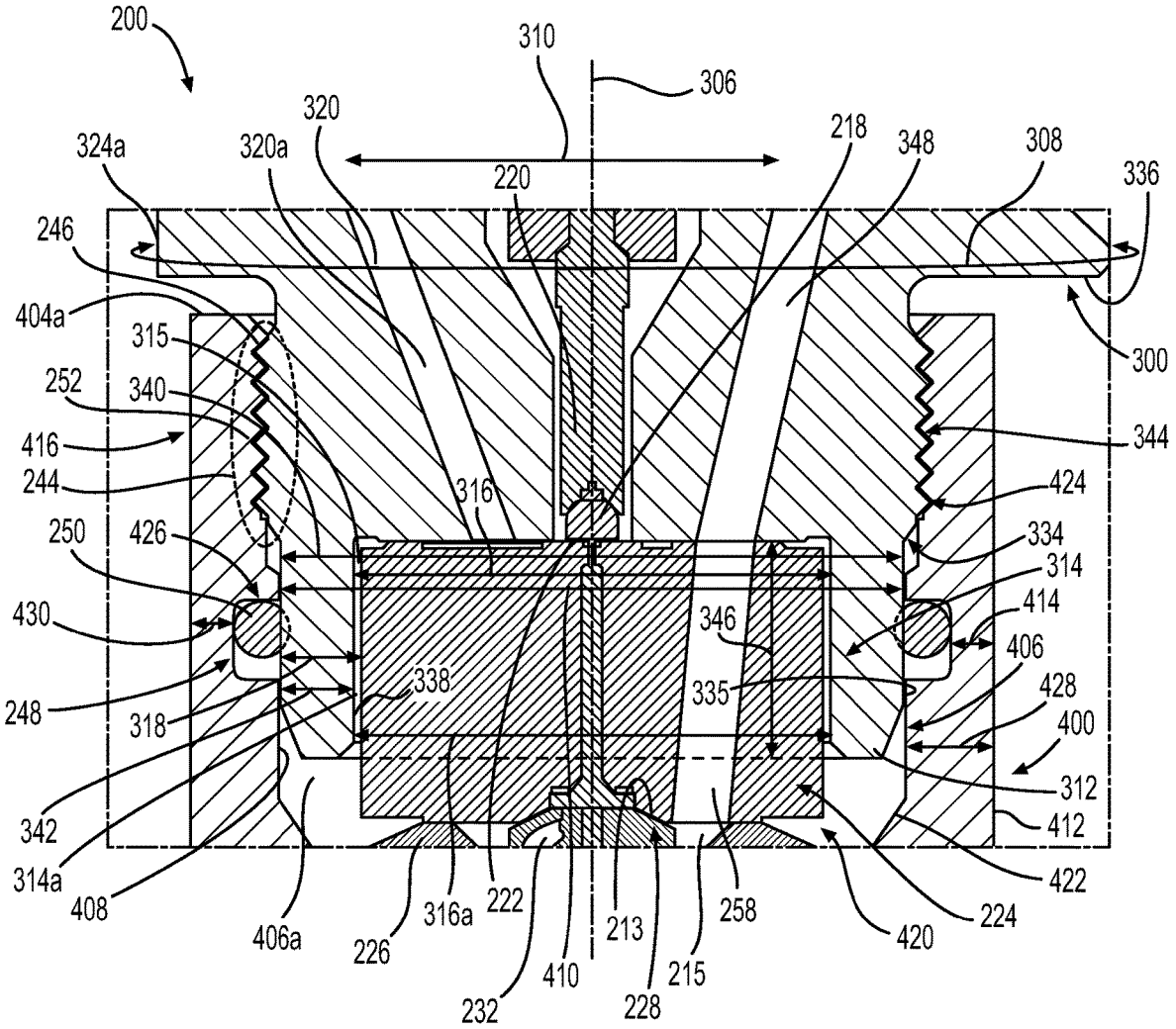
FIG. 4 is an enlarged detail view of the fuel injector assembly of FIG. 3, showing more clearly the radial seal and the thin wall counterbore.

Looking at FIGS. 3 and 4 together, the solenoid actuator 202 is operably coupled to a check valve member 214 that includes a closing hydraulic surface 213 exposed to fluid pressure in a pressurized fuel chamber 215 that is disposed in the nozzle 400. The check valve member 214 is movable between a closed position (as shown) blocking the injection outlet 402, and an open position fluidly connecting the common rail inlet 302 to the injection outlet 402. The check valve member 214 also includes an opening hydraulic surface 216 that is exposed to fluid pressure in the common rail inlet 302, which corresponds to pressure in a common rail (not shown).

As best seen in FIG. 4, a control valve member 218 may be provide (e.g. a ball) that is unattached to, but trapped between, a push pin 220 and a seat 222 of a valve plate 224. Control valve member 218 is movable between a closed position (as shown) in contact with seat 222, and an open position out of contact with seat 222 to fluidly connect the pressurized fuel chamber 215 to the drain outlet 304. The push pin 220 interacts at one end with armature 204 and at its opposite end with control valve member 218 to facilitate movement of control valve member 218 between its closed and open positions responsive to de-energizing and energizing the solenoid actuator 202, respectively.

Although other structures would fall within the intended scope of the present disclosure, the pressurized fuel chamber 215 is shown partially defined by a sleeve 226 and an orifice piece 228. A biasing spring 230 (see FIG. 3) may be operably positioned to simultaneously bias the sleeve 226 into contact with the orifice piece 228, and bias the check valve member 214 toward its downward closed position, as shown. Other springs 230*a*, 230*b* (see FIG. 6) may be provided to bias the push pin 220 into contact with the seat 222, and to bias the armature 204 toward contact with the push pin 220 respectively.

When fuel injector assembly 200 is in the injection configuration, the common rail inlet 302 is fluidly connected (fluid communication) to the drain outlet 304 through orifices 232 of the orifice piece 228 (see FIG. 4). These orifices may assist in more abruptly ending injection events by fluidly connecting the pressurized fuel chamber 215 to the high pressure in common rail inlet 302 at the end of an injection event. That is to say, these orifices 232 may be sized to influence the rate at which the needle/check valve member 214 lifts from its closed position to its open position by influencing the rate at which fuel escapes to drain outlet 304 past control valve member 218. These features may be omitted in other embodiments of the present disclosure.

The operation of this fuel injector assembly 200 during an injection event will be discussed later herein in more detail.

With continued reference to FIGS. 3 and 4, an embodiment of a fuel injector assembly 200 that may have features for limiting or dealing with leaks will now be discussed.

Starting with FIG. 3, the fuel injector assembly 200 may comprise a fuel injector component (e.g. a nozzle 400, a sleeve 226) that defines a pressurized fuel chamber 215, and a check valve assembly 214*a* that is in fluid communication with the pressurized fuel chamber 215. This check valve assembly 214 may be disposed in the nozzle 400 or sleeve 226, etc.

Also as best seen in FIG. 4, a fuel injector body 300 may be provided that includes an at least partially annular configuration defining a longitudinal axis 306 (may be a centerline), a circumferential direction 308, and a radial direction 310. A first end 312 may be disposed along the longitudinal axis, as well as a second end 312*a* (see FIG. 3). The fuel injector body 300 may further define a first counterbore 314, and a first cavity 314*a* (see FIG. 4) that extends longitudinally from the first end 312 toward the second end 312*a*, terminating short thereof.

In addition, a nozzle 400 may be provided that defines a first longitudinal end 404 (see FIG. 3), and a second longitudinal end 404*a* (see FIG. 4*a*) that is disposed longitudinally adjacent to the first end 312 of the fuel injector body 300. The nozzle may define a second counterbore 406 with a second cavity 406*a* that extends longitudinally from the second longitudinal end 404*a* toward the first longitudinal end 404.

When assembled as best seen in FIG. 4, the first end 312 of the fuel injector body 300 may be disposed in the second counterbore 406, and the second cavity 406*a* of the nozzle 400, forming an interface region 244 with the nozzle 400, and a seam 246 between the fuel injector body 300 and the nozzle 400. In this region, the fuel injector assembly 200 may further define a radial seal receiving groove 248 disposed longitudinally along the seam 246. This groove 248 may be formed on either the fuel injector body 300 or the nozzle 400. Before being assembled into the engine, a seal 250 would typically be disposed in the radial seal receiving groove 248.

For the embodiment shown in FIG. 4, the second cavity 406*a* of the nozzle 400 includes a radially inner circumferential surface 408 that defines the radial seal receiving groove 248.

To provide a robust design, the fuel injector assembly 200 may define a minimum seal receiving groove inner diameter 410, a minimum first cavity diameter 316 that is defined by a first cavity circumferential surface 315, and a ratio of the minimum seal receiving groove inner diameter 410 to the minimum first cavity diameter may range from 1.1 to 4.0.

More specifically, the fuel injector body 300 may define a radial wall thickness 318 that is disposed radially between the radial seal receiving groove 248, and the first cavity circumferential surface 315 that ranges from 5.0 mm to 22.0 mm.

Likewise, the nozzle 400 may define a radially outer circumferential surface 412, and a minimum radial wall thickness 414 measured radially from the radially outer circumferential surface 412 to the radial seal receiving groove 248 that ranges from 7.0 mm to 22.0 mm.

Looking more closely at the interface region 244 in FIG. 4, it can be seen that this region includes meshing threads 252. It is contemplated that other forms of interfacing or attaching the nozzle to the fuel injector body are possible, as well as other ratios and dimensional ranges in other embodiments of the present disclosure.

The fuel injector assembly may further comprise a valve plate 224 that is disposed in the first cavity 314*a*, an orifice piece 228 that is disposed in the nozzle 400 contacting the valve plate 224, and a control valve 218 disposed in the fuel injector body 300 above the valve plate 224 and the orifice piece 228. Other constructions are possible in other embodiments of the present disclosure.

Figure 5:
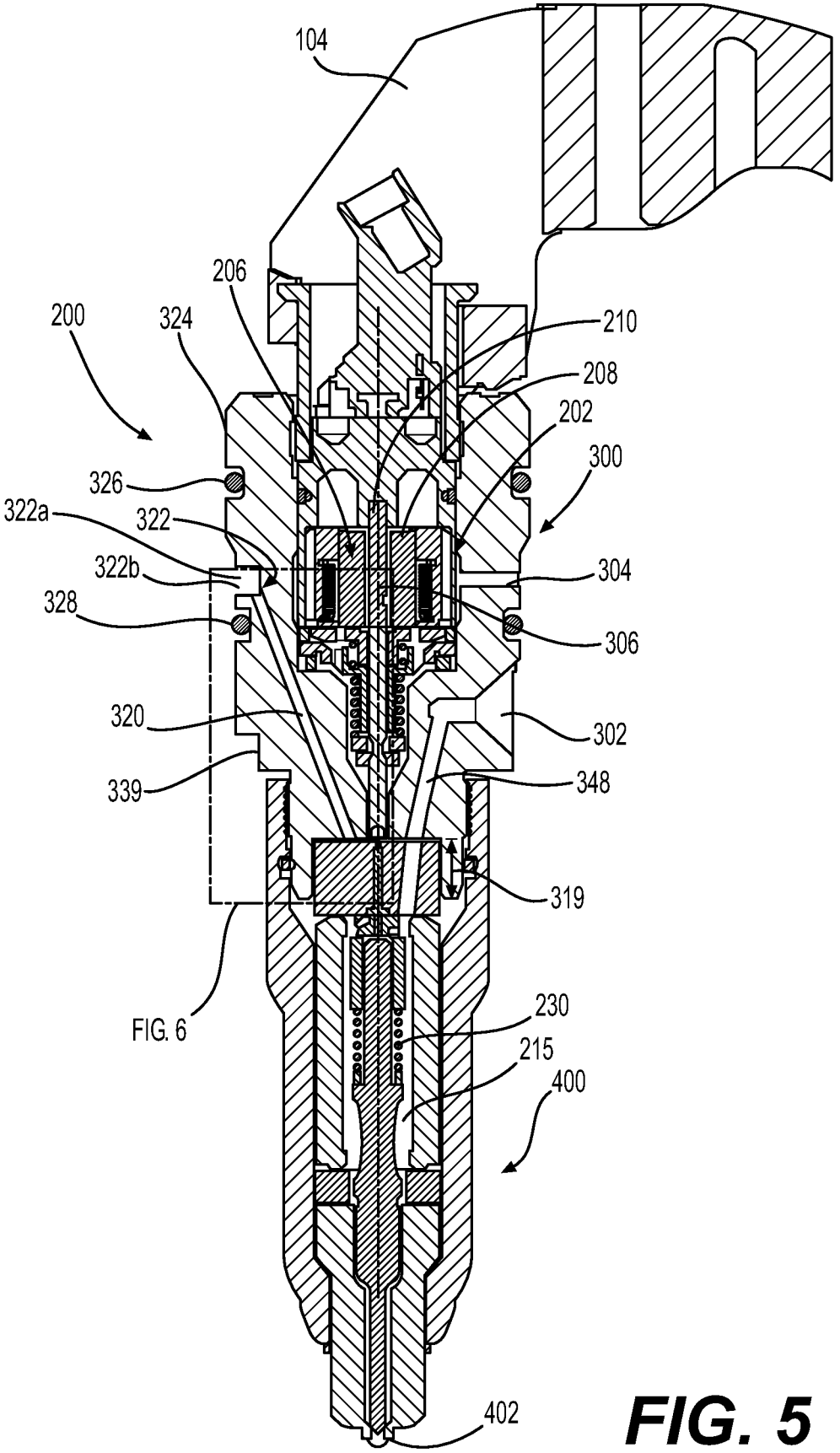
FIG. 5 is a sectional side view of a fuel injector assembly that may use a fuel injector body with an internal leak passage that connects the low pressure drain groove on the periphery of the fuel injector body to the counterbore cavity surrounded by the nozzle. The embodiments of FIGS. 3 and 5 may be substantially the same or even identical, but not necessarily so.

In some embodiments as best seen in FIGS. 5 and 6, the fuel injector body 300 may further define a drain passage 320 that is in communication with the first cavity 314*a* of the fuel injector body 300, as well as a low pressure drain cavity 322.

More particularly as best seen in FIG. 6, the fuel injector body 300 may further defines a radially outer circumferential surface 324, and the low pressure drain cavity 322 takes the form of a circumferential groove 322*a* disposed on the radially outer circumferential surface 324 axially between an upper seal 326 (see FIG. 5), and a lower seal 328.

Focusing on FIG. 6, the first cavity 314*a* may be defined by a bottom surface 330 (e.g. a planar annular surface) and the drain passage 320 is a bore (e.g. drilled using a convention drill or Electric Discharge Machining, etc.) that extends from the bottom surface 330 to the circumferential groove 322*a* along a direction that forms an oblique angle 332 with the longitudinal axis 306 in a plane containing the longitudinal axis 306, and the radial direction 310 (e.g. the sectioned plane of FIG. 6). Other orientations and configurations are possible for the bore in other embodiments of the present disclosure.

Next, components such as a fuel injector body and/or a nozzle that may be supplied as a replacement part to repair, refurbish, or retrofit a fuel injector assembly will now be discussed with reference to FIGS. 3 and 4.

Such a fuel injector body 300 shown in FIG. 4 may include an external interface portion 334 including a sealing surface 335 that is disposed axially between the first end 312, and a shoulder 336. More particularly, an externally threaded portion 344 may be disposed axially between the sealing surface 335, and the shoulder 336.

As mentioned previously, the first cavity 314*a* defines a bottom surface 330, and a peripheral surface 338 defining a first cavity diameter 316*a*. Also, the sealing surface 335 may define a sealing surface diameter 340, and a ratio of the sealing surface diameter 340 to the first cavity diameter 316 may range from 0.3 to 4.4 in some embodiments. In such embodiments, the body may define a radial thickness 342 from the sealing surface 335 to the peripheral surface 338 ranging from 5.0 mm to 22.0 mm. This may not be the case in other embodiments of the present disclosure.

Moreover in some embodiments, the first cavity 314*a* may define a first cavity axial depth 346 from the bottom surface 330 to the first end 312, and a ratio of the sealing surface diameter 340 to the first cavity axial depth 346 may range from 0.2 to 4.4. In such a case, the first cavity axial depth 346 may range from 5.0 mm to 30.0 mm. Other configurations, dimensions, and ratios are possible in other embodiments of the present disclosure.

As also alluded to earlier herein, a radially outer surface 324*a* may be disposed radially outwardly from the shoulder 336 that defines a low pressure drain groove 322*b* (see FIG. 6). A leak passage 320*a* may extend from the bottom surface 330 to the low pressure drain groove 322*b*, which in turn is in communication with the drain outlet 304 (see FIG. 5). High pressure may thus be relieved when a problem occurs, minimizing the risk of further damage to the components of the fuel injector assembly.

Looking at FIG. 3, a replacement nozzle 400 (may be an assembly as shown) may include a body that includes at least a partially stepped annular configuration that defines a radial direction, a circumferential direction, and a longitudinal axis as previously described with reference to the fuel injector body 300.

The nozzle 400 may include a first longitudinal end 404, and a second longitudinal and 404*a*. An attachment portion 416 may be disposed at the second longitudinal end 404*a*, while a tip portion 418 with the injection outlet 402 may be disposed at the first longitudinal end 404

Specifically as best seen in FIG. 4, the attachment portion 416 may include a fuel injector body receiving cavity 420 defining an inner circumferential surface 422 (may include any surface of revolution including conical, cylindrical, etc.) that includes internal threads 424 extending from the second longitudinal end 404*a*, and that defines a seal receiving groove 426 that is disposed axially below the internal threads 424.

To provide a robust design, the attachment portion 416 may include a maximum radial wall thickness 428 (e.g. slightly above or below the seal receiving groove 426) disposed circumferentially about the fuel injector body receiving cavity 420, and a minimum radial wall thickness 430 disposed circumferentially about the fuel injector body receiving cavity 420 (e.g. at the seal receiving groove 426). A ratio of the maximum radial wall thickness 428 to the minimum radial wall thickness 430 may range from 0.12 to 17.0 in some embodiments. In such a case, the maximum radial wall thickness 428 may range from 2.0 mm to 17.0 mm, while the minimum radial wall thickness 430 may range from 1.0 mm to 17.0 mm. In order to provide adequate sealing, the seal receiving groove 426 may be spaced away from the internal threads 424 a minimum axial distance 432 (see FIG. 6) that ranges from 2.0 mm to 25.0 mm. Other configurations, dimensional ratios, and dimensions are possible in other embodiments of the present disclosure.

Now, another embodiment of a fuel injector focused on providing pressure relief in the nozzle and the nozzle/fuel injector body interface will be discussed while looking at FIGS. 5 and 6.

As alluded to earlier herein, the fuel injector body 300 of the fuel injector assembly 200 may be disposed in the second counterbore 406, and the second cavity 406*a* of the nozzle 400, forming an interface region 244 with the nozzle 400, and a seam 246 between the fuel injector body 300, and the nozzle 400. The fuel injector body may further define a supply passage 348 in communication with the pressurized fuel chamber 215 and the common rail inlet 302 for supplying the fuel. Also, a leak passage 320*a* may extend from the first cavity 314*a*.

As best seen in FIG. 4, the fuel injector body 300 defines a bottom surface 330 of the first cavity 314*a*, and the leak passage 320*a* may extend from the bottom surface 330 radially on one side of the longitudinal axis 306, while the supply passage 348 extends to the bottom surface 330 radially on the other side of the longitudinal axis 306 in a plane containing the radial direction 310, and the longitudinal axis 306 (e.g. in the sectioned plane of FIG. 4).

In addition in FIG. 6, the fuel injector body 300 may include an outer peripheral surface 339 that that is disposed radially outwardly from the nozzle 400. The outer peripheral surface 339 may define a low pressure drain groove 322*b* that is in communication with the leak passage 320*a*. A valve plate 224 may be disposed in the first cavity 314*a*, including an abutting sealing surface 254 facing the bottom surface 330 of the first cavity 314*a*. This abutting sealing surface 254 may define a reservoir 256 that is in communication with the leak passage 320*a*, as well as a thru-passage 258 (see FIG. 4) that fluidly connects the supply passage 348 to the pressurized fuel chamber 215. The leak passage, the thru-passage, and the supply passage may all extend along directions that are oblique to the longitudinal axis and radial direction. Also, the supply passage and thru-passage may be oblique to each other (i.e. not straight with respect to each other). Other configurations are possible in other embodiments of the present disclosure.

In FIG. 6, the leak passage 320*a* may take the form of a straight bore (e.g. cylindrical) that is machined or otherwise formed into the fuel injector body 300. As such, the leak passage 320*a* may define a passage diameter 350, and the first cavity 314*a* may define a first cavity diameter 316*a* (see FIG. 4). A ratio of the first cavity diameter 316*a* to the passage diameter 350 may range from 2.0 to 10.0 in certain embodiments of the present disclosure. In such a case, the leak passage diameter may range from 1.0 mm to 5.0 mm. Other ranges are possible in other embodiments of the present disclosure.

For some embodiments of the fuel injector body of the present disclosure, these following features may also be present.

As alluded to previously, the fuel injector assembly 200 may further define a radial seal receiving groove 248 that is disposed longitudinally along the seam 246 (see FIG. 4) with a seal 250 that is disposed in the radial seal receiving groove 248. The radial seal receiving groove may be disposed axially below the bottom surface 330 of the first cavity 314*a*, but not necessarily so. For the embodiment shown in the figures, the second cavity 406*a* of the nozzle 400 includes a radially inner circumferential surface 422*a* that defines the radial seal receiving groove 248. This may not be the case for other embodiments of the present disclosure.

Various embodiments of a fuel injector body that may be provided as a replacement part, etc. for the fuel injector assembly just described will now be discussed with reference to FIGS. 4 thru 6.

The fuel injector body 300 may include an external interface portion 334 including a sealing surface 335 that is disposed axially between the first end 312 and a shoulder 336. The first cavity 314*a* defines a bottom surface 330 and a peripheral surface 338, while a leak passage 320*a* extends from the bottom surface 330 that is in communication with the first cavity 314*a*.

In some embodiments, the leak passage 320*a* extends along a direction that is oblique to the radial direction 310, and the longitudinal axis 306. In particular embodiments, the direction along which the leak passage extends is in the same plane as the radial direction and the longitudinal axis (e.g. the sectioned plane of FIG. 6). This may not be the case in other embodiments of the present disclosure. The fuel injector body 300 may further define a supply passage 348 that extends to the first cavity 314*a* as seen in FIG. 4, but not necessarily so.

In certain embodiments as seen in FIG. 6, the fuel injector body 300 may include a stepped configuration including a side circumferential surface 324*b* (e.g. any surface of revolution including a conical surface, a cylindrical surface) that is spaced radially and axially away from the shoulder 336, and the external interface portion 334. The side circumferential surface 324*b* defines a low pressure drain groove 322*b*, and the leak passage 320*a* extends to the low pressure drain groove 322. More specifically, the low pressure drain groove 322*b* defines a corner 352, and the leak passage 320*a* may extend to the corner 352 as shown, or some other portion of the groove such as its bottom surface, its side surface, etc.

In other embodiments, the fuel injector body 300 has an external male attachment portion 334*a* including a sealing surface 335 that is disposed axially between the first end 312, and a shoulder 336.

The peripheral surface 338 defines a cavity diameter 316*a*, and the sealing surface defines a sealing surface diameter 340, and a ratio of the sealing surface diameter 340 to the cavity diameter 316 may range from 0.3 to 4.4 in some embodiments of the present disclosure.

The external male attachment portion 334*a* includes external threads 344*a* that are disposed axially between the sealing surface 335 and the shoulder 336. A wall 354 is disposed circumferentially about the first cavity 314*a*, defining a minimum radial wall thickness 318*a*, and a maximum axial wall height 319 (see FIG. 5). In such a case, the minimum radial wall thickness 318*a* may range from 1.0 mm to 22.0 mm, and the maximum axial wall height 319 may range from 5.0 mm to 30.0 mm.

The fuel injector body and the nozzle may be made from similar materials such as steel.

INDUSTRIAL APPLICABILITY

In practice, a nozzle, a fuel injector body and/or a fuel injector assembly according to any embodiment described herein may be provided, sold, manufactured, and bought etc. to refurbish, retrofit or remanufacture existing fuel injector assemblies in the field. Similarly, a fuel injector assembly may also be provided, sold, manufactured, and bought, etc. to provide a new fuel injector that includes such a nozzle, a fuel injector body, or a fuel injector assembly. The fuel injector body, the nozzle, or fuel injector assembly may be new or refurbished, remanufactured, etc.

The present disclosure finds general applicability to fuel injectors for common rail fueling applications. The present disclosure finds specific application to common rail fuel injectors used in compression ignition engines. However, other applications in other types of engines and other types of fuel injectors are contemplated to be within the scope of the present disclosure.

In operation between injection events, fuel injector assembly 200 will be in a rest configuration, as shown. When in the rest configuration, solenoid actuator 202 is de-energized, armature 204 is in contact with push pin 220, and control valve member 218 is in its closed position in contact with the seat 222. In addition, in the rest configuration the check valve member 214 is in its downward closed position blocking the nozzle injection outlet 402. Also, in the rest configuration the pressure in the pressurized fuel chamber 215 is high such that rail pressure may be acting on both the closing hydraulic surface 213 and the opening hydraulic surface 216.

An injection event is initiated by energizing solenoid actuator 202. When this occurs, the pole piece 208 magnetically attracts the armature 204. As the armature 204 begins moving toward stator assembly 206, push pin 220 is lifted to allow the high pressure in pressurized fuel chamber 215 to push control valve member 218 off of the seat 222 to fluidly connect the pressurized fuel chamber 215 to the low pressure of drain outlet 304. The motion of armature 204 will stop when sit contacts the stop pin 210. When pressure in pressurized fuel chamber 215 drops sufficiently, the high pressure acting on opening hydraulic surface 216 pushes check valve member 214 upward against the action of biasing spring 230 to commence an injection event. When fuel injector is in the injection configuration, check valve member 214 is in its upward open position, control valve member 218 is in its open position out of contact with the seat 222, and push pin 220 is in contact with stop pin 210 and armature 204, with armature 204 being at a final air gap distance away from stator assembly 206.

During the injection event, pressures in the nozzle and fuel injector body may be high. The embodiments discussed herein may help to prevent the leaking of fuel at the interface between the nozzle and the fuel injector body, and/or may help to provide pressure relief so that fuel injector components are not damaged if a problem occurs such as a stuck component. In some applications such as common rail applications, the pressure in the nozzle and high pressure passage in the body may be high, not just during the injection event. When the ball (which may take the form of a flattened geometry to form a seat as shown in the drawings) lifts, the pressure on top of the check valve may be evacuated, inducing a pressure imbalance, allowing the check valve ball to lift, opening the tip to the check valve seat, allowing the injection event to occur.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A fuel injector body for use with a fuel injector, the fuel injector body comprising:

a body that includes an at least partially annular configuration defining a longitudinal axis, a circumferential direction, and a radial direction;

a first end that is disposed axially along the longitudinal axis, and a second end that is disposed axially along the longitudinal axis;

a first counterbore and a first cavity that extends from the first end toward the second end; and an external interface portion including an external sealing surface that is disposed axially between the first end and a shoulder;

wherein the first cavity defines a bottom surface and a peripheral surface, the peripheral surface defining a first cavity diameter, and the sealing surface defining a sealing surface diameter.

2. The fuel injector body of claim 1 wherein the body defines a radial thickness from the sealing surface to the peripheral surface ranging from 5.0 mm to 22.0 mm.

3. The fuel injector body of claim 1 wherein the first cavity defines a first cavity axial depth from the bottom surface to the first end.

4. The fuel injector body of claim 3 wherein the first cavity axial depth ranges from 5.0 mm to 30.0 mm.

5. The fuel injector body of claim 1 wherein the external interface portion includes an externally threaded portion that is disposed axially between the sealing surface and the shoulder.

6. The fuel injector body of claim 3 wherein the body further includes a radially outer surface that is disposed radially outwardly from the shoulder, the radially outer surface defining a low pressure drain groove, and the body defining a leak passage extending from the bottom surface to the low pressure drain groove.

7. A nozzle for use with a fuel injector, the nozzle comprising:

a body that includes at least a partially stepped annular configuration that defines a radial direction, a circumferential direction, and a longitudinal axis;

a first longitudinal end that is disposed axially along the longitudinal axis, and a second longitudinal end that is disposed axially along the longitudinal axis;

an attachment portion that is disposed at the second longitudinal end; and a tip portion disposed at the first longitudinal end defining an injection outlet;

wherein the attachment portion includes a fuel injector body receiving cavity defining an inner circumferential surface that includes internal threads extending from the second longitudinal end, and the inner circumferential surface also defines a seal receiving groove that is disposed directly axially below the internal threads.

8. The nozzle of claim 7 wherein the attachment portion includes a maximum radial wall thickness disposed circumferentially about the fuel injector body receiving cavity, a minimum radial wall thickness disposed circumferentially about the fuel injector body receiving cavity.

9. The nozzle of claim 8 wherein the maximum radial wall thickness ranges from 2.0 mm to 17.0 mm, while the minimum radial wall thickness ranges from 1.0 mm to 17.0.

10. The nozzle of claim 7 wherein the seal receiving groove is spaced away from the internal threads a minimum axial distance that ranges from 2.0 mm to 25.0 mm.

11. A fuel injector assembly comprising:

a fuel injector component that defines a pressurized fuel chamber;

a check valve assembly in fluid communication with the pressurized fuel chamber; and a fuel injector body that includes an at least partially annular configuration defining a longitudinal axis, a circumferential direction, a radial direction, and a first end disposed along the longitudinal axis, a second end disposed along the longitudinal axis, and also defining a first counterbore, and a first cavity that extends longitudinally from the first end toward the second end terminating short thereof; and a nozzle that defines a first longitudinal end, and a second longitudinal end that is disposed longitudinally adjacent to the first end of the fuel injector body, and a second counterbore and a second cavity that extends longitudinally from the second longitudinal end toward the first longitudinal end;

wherein the first end of the fuel injector body is disposed in the second counterbore and the second cavity of the nozzle, forming a threaded interface region with the nozzle, and a seam between the fuel injector body and the nozzle that is directly axially below the threaded interface region, and the fuel injector assembly further defines a radial seal receiving groove disposed longitudinally along the seam.

12. The fuel injector assembly of claim 11 further comprising a seal that is disposed in the radial seal receiving groove.

13. The fuel injector assembly of claim 11 wherein the second cavity of the nozzle includes a radially inner circumferential surface that defines the radial seal receiving groove.

14. The fuel injector assembly of claim 11 wherein the fuel injector assembly defines a minimum seal receiving groove inner diameter, a minimum first cavity diameter that is defined by a first cavity circumferential surface, and a ratio of the minimum seal receiving groove inner diameter to the minimum first cavity diameter ranges from 1.1 to 4.0.

15. The fuel injector assembly of claim 14 wherein the fuel injector body defines a radial wall thickness disposed radially between the radial seal receiving groove and the first cavity circumferential surface ranging from 5.0 mm to 22.0 mm.

16. The fuel injector assembly of claim 13 wherein the nozzle defines a radially outer circumferential surface and a minimum radial wall thickness measured radially from the radially outer circumferential wall surface to the radial sealing receiving groove ranges from 7.0 mm to 22.0 mm.

17. The fuel injector assembly of claim 11 wherein the check valve is disposed in the nozzle, and further comprising valve plate disposed in the first cavity, an orifice piece disposed in the nozzle contacting the valve plate, and a control valve disposed in the fuel injector body above the valve plate.

18. The fuel injector assembly of claim 11 wherein the fuel injector body further defines a drain passage that is in communication with the first cavity of the fuel injector body, and the fuel injector body further defines a low pressure drain cavity.

19. The fuel injector assembly of claim 18 wherein the fuel injector body further defines a radially outer circumferential surface and the low pressure drain cavity is a circumferential groove disposed on the radially outer circumferential surface axially between an upper seal and a lower seal.

20. The fuel injector assembly of claim 19 wherein the first cavity is defined by a bottom surface and the drain passage is a bore that extends from the bottom surface to the circumferential groove along a direction that forms an oblique angle with the longitudinal axis in a plane containing the longitudinal axis and the radial direction.

* * * * *